United States Patent [19]

Antoniazzi et al.

[11] Patent Number: 4,794,227

[45] Date of Patent: Dec. 27, 1988

[54] ELECTRICAL RESISTANCE HEATER ELEMENT FOR ROOM AIR HEATER

[75] Inventors: Giansante Antoniazzi, Conegliano; Claudio Fattorel, Vittorio Veneto Treviso, both of Italy

[73] Assignee: R.I.C.A. Resistenze Industriali Corazzate E, Treviso, Italy

[21] Appl. No.: 143,347

[22] Filed: Jan. 13, 1988

[30] Foreign Application Priority Data

Jan. 27, 1987 [IT] Italy ..... 61905/87[U]

[51] Int. Cl.[4] ..... H05B 3/02; H01C 1/01; H01C 3/10

[52] U.S. Cl. ..... 219/375; 219/370; 219/536; 219/542; 338/57; 338/58; 338/290; 338/294; 338/321

[58] Field of Search ..... 219/369–376, 219/381, 382, 542, 536, 532; 338/279–284, 318, 321, 294, 287, 290, 57, 58

[56] References Cited

U.S. PATENT DOCUMENTS

| | | | |
|---|---|---|---|
| 3,237,142 | 2/1966 | Nuss | 338/280 |
| 4,341,946 | 7/1982 | Ohnmacht et al. | 219/370 X |
| 4,636,615 | 1/1987 | Petz | 219/375 X |

FOREIGN PATENT DOCUMENTS

| | | | |
|---|---|---|---|
| 2530369 | 1/1977 | Fed. Rep. of Germany | 219/375 |
| 2497049 | 1/1982 | France | 219/375 |

*Primary Examiner*—Anthony Bartis

*Attorney, Agent, or Firm*—Hoffman, Wasson, Fallow

[57] ABSTRACT

A resistance heater element for an electric room heater includes a resistive heating conductor (1) supported by an insulating support (2) mounted on the support flange (9) of an electric fan (4) in the heater which passes a stream of room air across the conductor (1). The insulating support (2) is cylindrical, with its axis parallel to the direction of the air stream, and includes at least one pair of nested mica bands (5, 5') bound together by fillets (6) connected to the support flange (9). The heating conductor (1) comprises at least one wire of resistive material bent in a zig-zag manner to form a plurality of radial loops each having portions extending inwardly and outwardly of the cylindrical bands (5, 5'). The central portion (11) of each loop is bent over and retained between the pair mica bands (5, 5') with the inner portion of each loop emerging radially from the inner band (5) through apertures (13) provided therein.

6 Claims, 1 Drawing Sheet

ELECTRICAL RESISTANCE HEATER ELEMENT FOR ROOM AIR HEATER

This invention relates to an electrical resistance heater element for room air heaters.

An object of the invention is to provide an electrical resistance heater element for application to fans in order to generate a flow of hot air.

A further object of the invention is to provide an electrical resistance heater element which has lower air resistance and results in higher overall efficiency than known elements used for the same purpose.

A further object of the invention is to provide an electrical resistance heater element which is of simple and economical construction.

These and further objects which will be apparent from the description given hereinafter are attained according to the invention by an electrical resistance heater element for room air heaters, comprising a heating conductor mounted on an insulating support. The insulating support is mounted on a support flange to which can be fitted an electric motor provided with a fan which passes a stream of air across the heating conductor. The insulating support is of cylindrical form with its axis parallel to the direction of the stream of the air to be heated and consists of at least one pair of mica bands kept superposed by a fillet fixed to brackets for connection to the support flange. Furthermore the heating conductor comprises at least one wire of resistive material bent in zig-zag manner to form a plurality of radial loops, with their inner portions bent over and retained between the two mica bands and emerging radially from the inner band through apertures provided therein.

The present invention is described in greater detail hereinafter with reference to the accompanying drawings in which.

Figure 1:
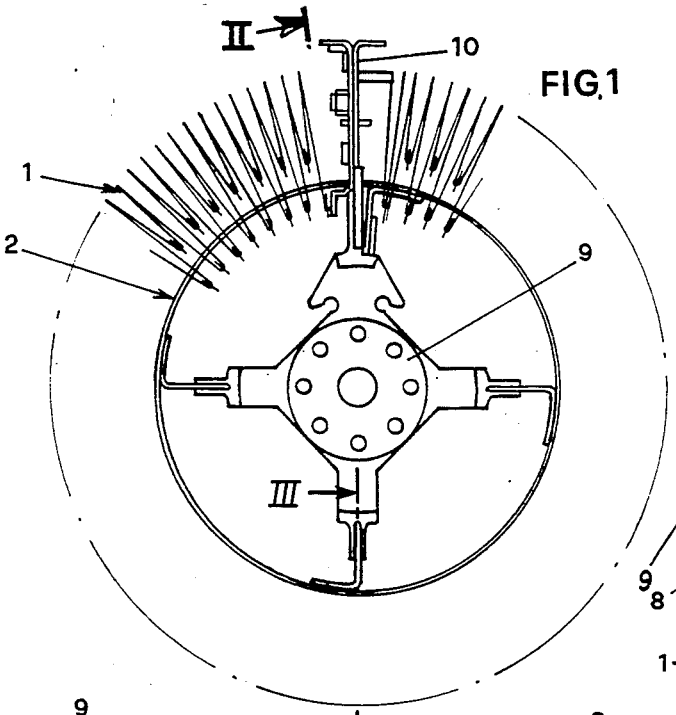
FIG. 1 is a frontal view of a deive according to the invention.
Figure 2:
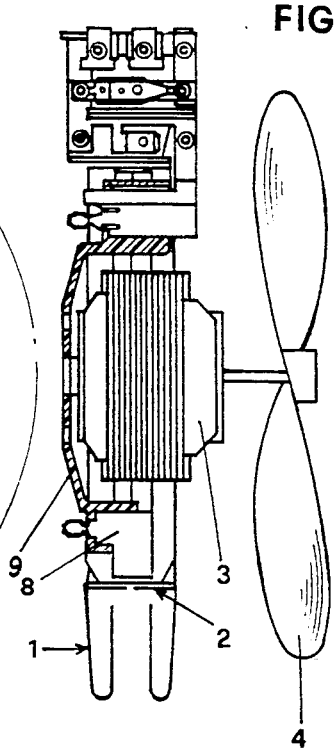
FIG. 2 is a diametrical section therethrough on the line II—II of FIG. 1.

As can be seen from the figures the electrical resistance heater element according to the invention comprises essentially a heating conductor 1 of resistive wire, and an insulating support 2 which represents both the insulating support member for the resistive wire 1 and the member for connecting the assembly to an electric motor 3 provided with a conventional fan 4 for generating a stream of air to be heated.

More specifically, the insulating support 2 comprises two side-by-side pairs of superposed cylindrical mica bands 5,5' held together by two U-shaped metal connecting fillets 6 which extend along the circular extension of the band 5,5'. The two fillets 6 adjoin each other along their centre line and are retained by four support brackets 8 positioned 90° apart. The fillets 6 are connected to each bracket 8 by a pair of appendices 7 provided on the bracket and passing through the facing flanges of each fillet 6 and the two mica bands 5,5' held therebetween, to be locked in their final position by being bent over.

The four brackets 8 are fixed to a support flange 9 constructed of insulating material, such as polymide, and the electric motor 3 provided with the fan 4 is fitted to this flange.

A lug 10 is also fitted to the said support flange 9 for connection to the electricity supply mains.

The heating conductor 1 consists of an electric wire of resistive material bent in zig-zag manner to form two sets of radial "loops" disposed in two separate planes orthogonal to the axis of the insulating cylindrical support 2.

Figure 3:
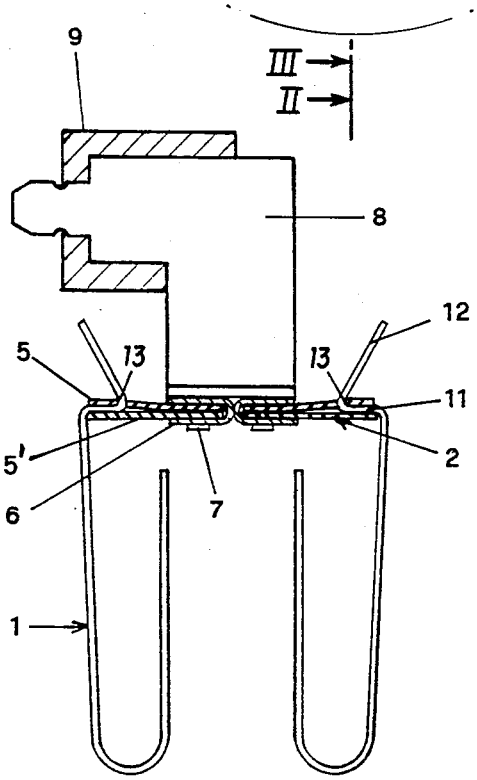
FIG. 3 is a detailed sectional view taken along the line III—III in FIG. 1.
Figure 4:
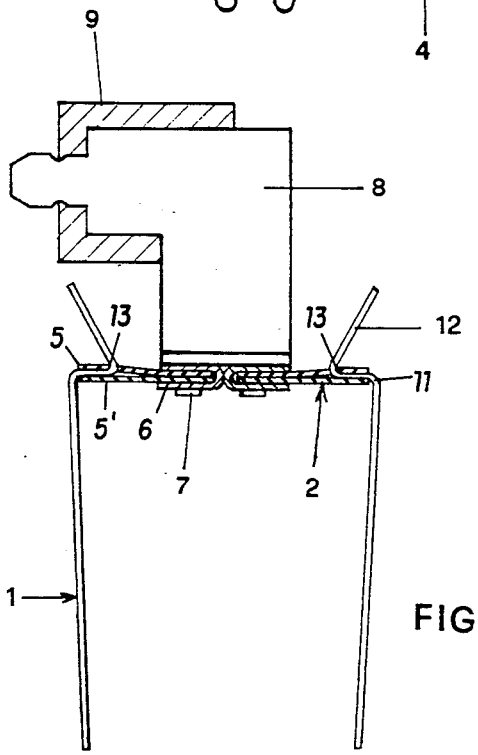
FIG. 4 shows a different form of the resistance element in the same view as FIG. 3.

The outer portion of the loops of each set can be either bent through 180° inwards towards the adjacent set (see FIG. 3) or can remain extended, according to the electrical power of the resistive conductor used, whereas the inner portion of each loop is bent firstly though 90° and is then bent in the opposite direction so as to produce a portion 11 substantially orthogonal to the plane of the loops followed by a portion 12 which lies at an angle to the portion 11.

On assembly, the orthgonal portion 11 is positioned between the two mica bands 5,5' of each pair, whereas the inner end portion 12 is passed through the inner mica band 5' through apertures 13 provided for this purpose.

The operation of the heater element according to the invention is conventional. When connected to the electricity supply mains the electric motor 3 rotates the fan 4 to pass a stream of air across two sets of loops, so heating it.

From the aforegoing it is apparent that the heater element according to the invention has considerable advantages over known heater element, and in particular:

an improved efficiency as its cylindrical form with its axis parallel to the air stream results in low air resistance, simpler construction as the resistance element 1 is secured to the mica support 2 merely by bending the loops over without using screws, rivets or the like, the possibility of using the same support and the same construction system for heating elements of different power, which differ from each other only by the outer portion of the loops being either bent over or not, this bending being carried out as a single operation for all the loops. It should be noted that the facility for bending the loops over means that for equal performance a greater useful space can be obtained within the insulating support.

I claim:

1. An electrical resistance heater element for room air heaters, comprising a heating conductor (1) mounted on an electrically insulating support (2) which is itself mounted on a support flange (9) to which can be fitted an electric motor (3) provided with a fan (4) which passes a stream of air across the heating conductor (1), wherein the insulating support (2) is of cylindrical form with its axis adapted to be positioned parallel to the direction of the stream of the air to be heated and consists of at least one pair of nested cylindrical mica bands (5,5') kept superposed by fillets (6), each rigid with a pair of circumferentially spaced brackets (8) connected to said support flange (9), and wherein the heating conductor (1) comprises at least one wire of resistive material bent in zig-zag manner to form a plurality of radial loops, each having portions extending inwardly and outwardly of said cylindrical bands, with the central portion of each loop bent over and retained between the two mica bands (5,5') and the inner portion of each loop emerging radially from the inner band through apertures (13) provided therein.

2. A heater element as claimed in claim 1, comprising two pairs of such nested mica bands (5,5') disposed end to end and held together by two separate sets of U-shaped fillets (6), which fillets are kept adjoining along their center line by said connection brackets (8), each of the pairs of mica bands mounting a heating wire bent in said zig-zag manner and being supported by said central portion of each radial loop.

3. A heater element as claimed in claim 1, wherein each connection bracket (8) is provided with at least one appendix (7) which passes through the retainer fillet (6) associated with the bracket and the interposed engaging mica bands (5,5') and is then bent over the outer flange of said fillte (6).

4. A heater element as claimed in claim 1, wherein each loop of the heating conductor (1) has a predominant outer portion extending external to the insulating suport (2), a subsequent central protion (11) bent substantially at 90° to the predominant portion and positioned between the two mica bands (5,5'), and an inner portion (12) bent at an angle to said central portion and emerging radially from the inner mica band (5').

5. A heater element as claimed in claim 1, wherein the heating conductor (1) consists of two sets of loops positioned substantially in two planes which are orthogonal to the axis of the insulating support (2) and pass through the two outer edges of the mica bands (5,5').

6. A heater element as claimed in claim 1, wherein the loops of each heating conductor (1) consist of said inner, central and outer portions, of which the outer portion is bent inwards through 180° in relation to the inner portion.

* * * * *